US008393405B2

(12) United States Patent
Lavesi et al.

(10) Patent No.: US 8,393,405 B2
(45) Date of Patent: Mar. 12, 2013

(54) PORTABLE AEROSOL FIRE-EXTINGUISHER WITH A STRIKER STARTING DEVICE

(75) Inventors: Giuseppe Lavesi, Pino Torinese (IT); Giovanni Gaidano, Pecetto Torinese (IT)

(73) Assignee: E.S.P. S.R.L., Turin (IT)

( * ) Notice: Subject to any disclaimer, the term of this patent is extended or adjusted under 35 U.S.C. 154(b) by 242 days.

(21) Appl. No.: 12/810,349

(22) PCT Filed: Dec. 24, 2007

(86) PCT No.: PCT/IT2007/000911

§ 371 (c)(1),
(2), (4) Date: Jun. 24, 2010

(87) PCT Pub. No.: WO2009/081431

PCT Pub. Date: Jul. 2, 2009

(65) Prior Publication Data

US 2010/0270042 A1 Oct. 28, 2010

(51) Int. Cl.
*A62C 13/22* (2006.01)

(52) U.S. Cl. ..... 169/84; 169/30

(58) Field of Classification Search ..... 169/84, 169/85, 88, 89, 28, 35, 30
See application file for complete search history.

(56) References Cited

U.S. PATENT DOCUMENTS 5,992,528 A * 11/1999 Parkinson et al. ..... 169/6
7,143,833 B2 * 12/2006 Gaidano et al. ..... 169/30

FOREIGN PATENT DOCUMENTS

| | | | |
|---|---|---|---|
| DE | 2838316 | A1 | 3/1980 |
| EP | 1479414 | A | 11/2004 |
| EP | 1484088 | A | 12/2004 |
| WO | 9315793 | A1 | 8/1993 |
| WO | 0037142 | A1 | 6/2000 |

OTHER PUBLICATIONS

International Search Report based off PCT/IT2007/000911 dated Aug. 22, 2008 (3 pages).

* cited by examiner

*Primary Examiner* — Christopher Kim
(74) *Attorney, Agent, or Firm* — Hickman Palermo Truong Becker Bingham Wong LLP

(57) ABSTRACT

A portable fire-extinguisher comprises a metal casing (3) with an internal chamber (4) for housing a charge (5) of a solid substance which can be transformed, at a predetermined temperature, into an aerosol with flame-extinguishing properties. A delivery opening (7) puts the chamber (4) into communication with the exterior. An explosive cartridge primer (10), associated with a striker mechanism (13), is provided for triggering the reaction of the extinguishing charge (5). The primer (10) and the striker mechanism (13) are located near a distal end (5*a*) of the charge (5) so as to trigger the chemical reaction of the charge (5) from that end.

9 Claims, 2 Drawing Sheets

PORTABLE AEROSOL FIRE-EXTINGUISHER WITH A STRIKER STARTING DEVICE

The present invention relates to a portable aerosol fire-extinguisher of the type defined in the preamble of claim 1, i.e. comprising a casing with an internal chamber for housing a charge of a solid substance which can be transformed, at a predetermined temperature, into an aerosol with flame-extinguishing properties, a delivery opening which puts the chamber into communication with the exterior, starting means for triggering the reaction of the extinguishing charge, an explosive starting capsule, and a striker mechanism associated with the explosive capsule.

A portable fire-extinguisher of the above-mentioned type is known from patent publication EP 1 479 414 A1. Such a fire-extinguisher provides a substantial advantage with respect to a conventional portable fire-extinguisher of the kind disclosed in patent publication WO-00/37142, wherein an electrical resistor, supplied by batteries, via a switch, is provided for triggering the transformation of the extinguishing charge from solid to aerosol. These conventional electrically activated fire-extinguishers have a disadvantage which is connected with the limited endurance of the batteries over time. As is known, batteries in fact become discharged after a number of months and, unless the user remembers to replace them periodically, there is a risk that the fire-extinguisher will not operate when required because the batteries are discharged.

For a better understanding of the state of the art and problems related thereto, there will be at first described a portable fire-extinguisher of known kind disclosed in EP 1 479 414 A1, reference being made to FIG. 1 of the appended drawings. A charge 5 of a solid substance which can be transformed, at a predetermined temperature, into an aerosol with flame-extinguishing properties is housed in a metal tubular casing 3 to which a plastic body 1 forming a handle 2 is attached. An explosive capsule 10 is fitted centrally inside the supporting body 1 in front of a firing mechanism including a striker 14. By pulling and then releasing a ring 22, the striker hits the starting capsule 10, which explodes. A flare resulting from the explosion of the capsule is propagated through a central shaft 9 in the extinguishing charge, reaches a flame-diffuser diaphragm 8 at the distal end of the extinguisher and is reflected thereby, so as to be radiated against the distal end portion 5*a* f the extinguishing charge 5, triggering its chemical reaction. The aerosol fluid produced by the combustion of the extinguishing charge is discharged energetically from a delivery hole 7 in a metal plug 6 and can be directed towards the fire.

With a fire-extinguisher of that kind, a problem arises in that the chemical reaction of the charge 5 is inevitably also triggered at the proximal end, near the capsule 10. As a result, the reaction propagates simultaneously from the bottom and the top of the solid charge, and also from and along the wall of the central shaft 9. In most cases the aerosol flow does not last long enough to extinguish a fire. A rapid pressure increase takes place in the centre of the fire-extinguisher, near the triggered proximal end of the solid charge 5. Gas overpressure within the fire-extinguisher is to be avoided, since it causes the whole metal casing 3 and the solid charge 5 to be dangerously blown off the handle 2, without extinguishing the fire.

The object of the present invention is therefore to provide a reliable and safe portable aerosol fire-extinguisher, capable of overcoming the above discussed drawbacks. This and other objects and advantages which will be understood better from the following description are achieved, according to the invention, by a portable aerosol fire-extinguisher as defined in the appended claims.

The structural and functional features of a preferred but non-limiting embodiment of a portable fire-extinguisher according to the invention will now be described; reference is made to the appended drawings, in which.

Figure 1:
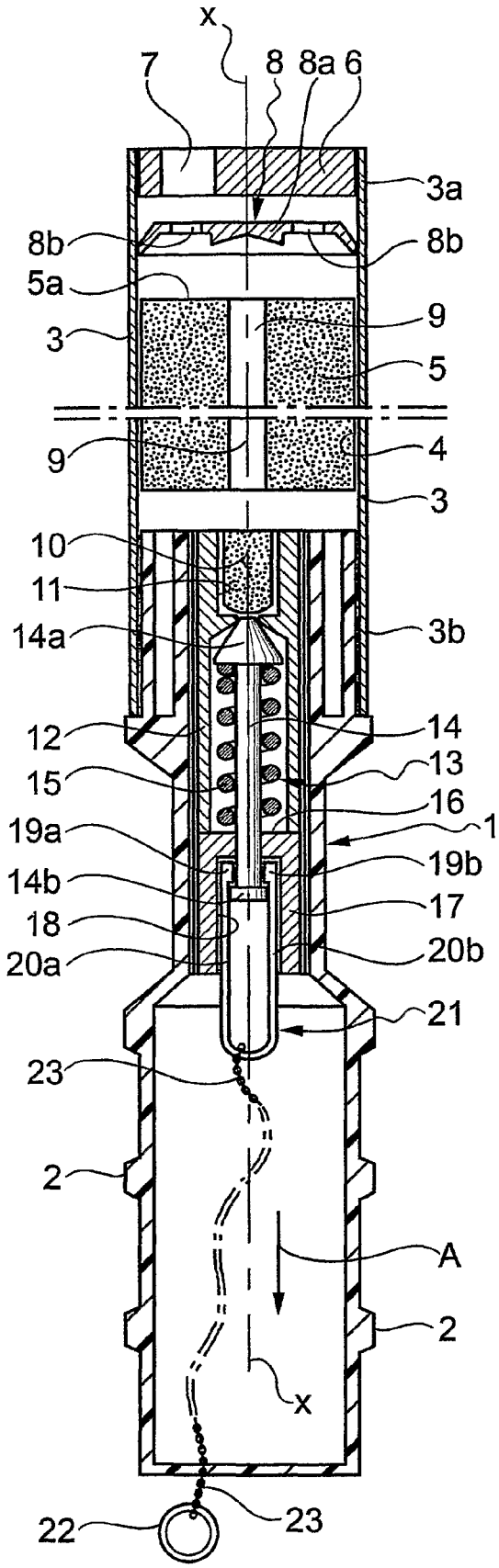
FIG.1 (PRIOR ART)
FIG. 1 is an axial cross-sectional view showing a portable fire-extinguisher of known kind.

Before an embodiment of the invention is explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

Figure 2:
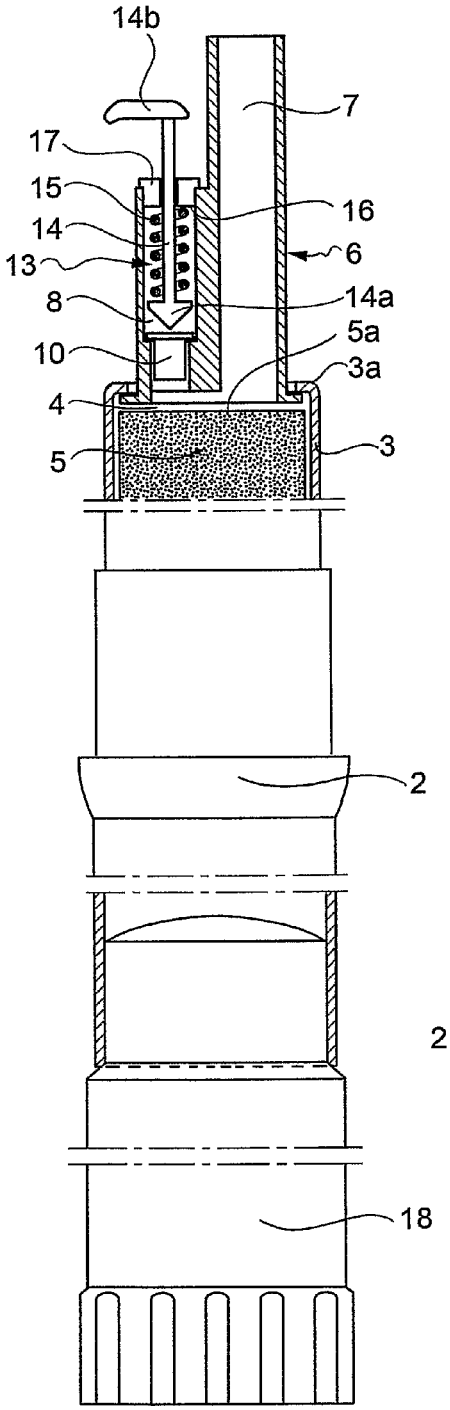
FIG. 2 is a schematic, partially sectioned longitudinal view showing a portable fire-extinguisher according to the present invention.
Figure 3:
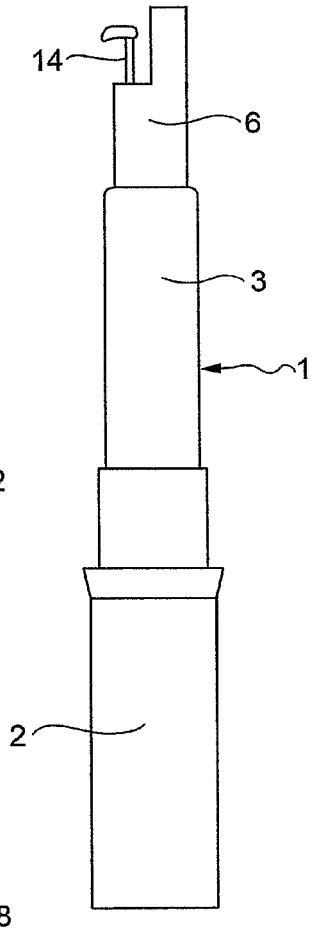
FIG. 3 is a side view, to a reduced scale, of the fire-extinguisher of FIG. 2.
Figure 4:
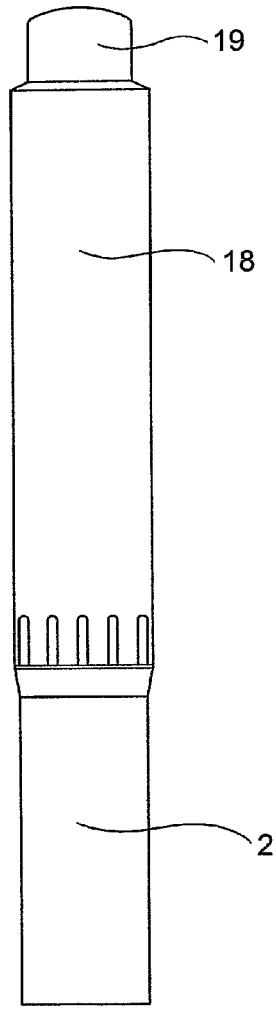
FIG. 4 is a side view of the fire-extinguisher of FIG. 3 with a protective cover.

Referring now to FIGS. 2 to 4, a portable fire-extinguisher comprises a supporting body 1 which is made of plastics material and is so shaped as to form a hollow handle portion 2. Indicated 3 is an elongate tubular casing with a proximal end fixed to the plastics body 1 and an inwardly projecting rim or flange 3*a* at its distal end. A chamber 4 is defined inside the hollow casing 3 for a charge 5 of a solid substance which can be transformed, at a predetermined temperature, into an aerosol with flame-extinguishing properties. The chemical and physical characteristics of the extinguishing charge 5 are not relevant per se for the purposes of an understanding of the invention and will not therefore be described in detail herein. By way of indication, the extinguishing charge is a compacted mixture comprising potassium nitrate, a binding resin, and an organic oxidizing agent.

Fixed at the distal end flange 3*a* of the tubular metal casing 3 is a metal body 6 forming two parallel, longitudinal shafts: a delivery shaft 7 which puts the internal chamber 4 into communication with the exterior, and a second shaft or cavity 8. Terms indicating directions and orientations such as "longitudinal" and "transverse" or "radial" are intended to be understood herein with reference to the longitudinal central axis of the fire-extinguisher, unless indicated otherwise. Similarly, terms such as "distal" and "proximal" refer to a normal condition of use of the fire-extinguisher in a user's hands.

The second shaft 8 accommodates an explosive capsule 10 and a firing mechanism 13 associated therewith. The capsule 10 is held in a two-diameter seat 11 formed by a narrower proximal length 8*b* of the second shaft 8, which opens into the chamber 4 near the distal end 5*a* of the aerosol-forming charge 5. The firing mechanism 13 comprises a striker element 14 with an enlarged head 14*a* and a striker-operating spring 15, interposed between the head 14*a* and a reaction surface 16 which is oriented transversely relative to the principal longitudinal axis of the fire-extinguisher. The reaction surface 16 is formed by a pierced plug 17 fitted in the distal end 8*a* of the second shaft 8. Indicated 14*b* is a handle or gripping portion of the striker 14.

The explosive capsule 10 is a cartridge primer of the kind normally used for firing a powder charge, containing a compound that may be exploded by percussion, typically fulminate of mercury.

The fire-extinguisher according to the invention operates as follows. When the user sees the need, he grips the handle 14*b* and pulls striker away in the distal direction, compressing the spring 15. By releasing the handle, the spring will cause the striker to strike the starting capsule 10, which explodes. The small flare resulting from the explosion of the capsule 10 immediately reaches the distal end portion 5*a* of the extinguishing charge 5, triggering its chemical reaction. The aerosol fluid produced by the combustion of the extinguishing charge is discharged energetically through the delivery shaft 7 and can be directed towards the fire.

The operating principle of the fire-extinguisher is based on the chemical reaction which, when triggered by the starting device constituted by the explosive capsule 10 and by the striker mechanism 13, brings the mixture of potassium salts to a temperature of about 300° C., giving rise to an exothermic reaction which produces an aerosol suspension of particles of extremely small particle size; these particles, which are discharged from the chamber 4 through the delivery shaft 7 owing to the pressure which accompanies the reaction, are spread over the source of a fire, inhibiting the combustion-supporting effect of oxygen and suffocating the propagation of the fire.

As will be appreciated, the chemical reaction of the charge 5 is triggered at the distal end of the fire-extinguisher. No overpressure can build up inside the device, thereby avoiding the drawbacks discussed in the introductory part of the description. No conventional reflector such as that indicated at 8 in FIG. 1 is necessary. Furthermore, the extinguishing charge 5 is shaped as a full cylinder, with no conventional longitudinal duct or passage 9 through it. This provides a simplified manufacture of the charge 5 and increases its mass at equal length. Above all, the reaction will begin at the distal end of the charge 5 and will spread and proceed uniformly towards the proximal end, generating a long lasting stream of aerosol forcefully shooting forth from the delivery shaft.

The elongate delivery shaft 7 directs the output flow of aerosol in a straight line, so that it may be focused precisely towards the fire. Further, the aerosol coming out of the delivery shaft will have somewhat reduced its temperature while travelling along the shaft 7. The metal body 6 forming the parallel shafts 7 and 8 preferably has a transversal size not exceeding that of the tubular casing 3. Thus, a protective tubular plastic cap 18 can be fitted over the body 6 and partly or fully also over the casing 3 (FIG. 4). Besides covering and protecting the firing mechanism 13 and sealing the access to the chamber 4, the cap 18 may advantageously also form a restricted tip 19 that fits into the hollow bottom part of the handle portion to serve as an extension that will help to hold the hottest part of the extinguisher further away from the user's hand.

The invention claimed is:

1. A portable aerosol fire-extinguisher comprising:

a casing with an internal chamber;

an extinguishing charge of a solid substance which can be transformed by chemical reaction, at a predetermined temperature, into an aerosol with flame-extinguishing properties, said extinguishing charge being housed within said internal chamber;

a delivery opening which is located at a distal end of the fire-extinguisher and which puts the internal chamber into communication with the exterior, a starter for triggering the chemical reaction of the extinguishing charge, the starter comprising an explosive starting capsule and a striker associated therewith, the starter being located at the distal end of the fire-extinguisher, so as to trigger the chemical reaction of the extinguishing charge from said distal end;

wherein the starter is mounted in a rigid hollow body fixed to a distal end of the casing also forming said delivery opening;

wherein said hollow body forms first and second cavities located side by side and both in communication with the internal chamber, the first cavity extending to said delivery opening, and the second cavity accommodating the explosive capsule and the associated striker.

2. A fire-extinguisher according to claim 1 wherein the two cavities are two substantially parallel, longitudinal shafts.

3. A fire-extinguisher according to claim 2 wherein said delivery opening is aligned with the longitudinal shaft defining the first cavity and opens at a free end thereof.

4. A fire-extinguisher according to claim 3 wherein the longitudinal shaft defining the first cavity is longer than the longitudinal shaft defining the second cavity, so that the delivery opening lies in a distal position with respect to the starter.

5. A fire-extinguisher according to claim 1 wherein the explosive capsule is a cartridge primer containing a compound that may be exploded by percussion.

6. A fire-extinguisher according to claim 5 wherein the striker may be operated by a user so as to percuss the explosive capsule.

7. A fire-extinguisher according to claim 1 wherein the hollow body has a transverse size not exceeding that of the casing.

8. A fire-extinguisher according to claim 1 further comprising a protective cap removably fitted over the hollow body.

9. A fire-extinguisher according to claim 8 further comprising a handle having a hollow bottom and wherein the protective cap forms a restricted tip received in the hollow bottom of the handle.

* * * * *